US005310101A

United States Patent [19]

Park et al.

[11] Patent Number: 5,310,101

[45] Date of Patent: May 10, 1994

[54] BELT BUCKLE FOR STORING A SPARE KEY FOR AN AUTOMOBILE

[75] Inventors: Bae-Wook Park, 105-303 Chugong Apt., 210 Kao-dong, Tong-gu, Taejon-City; Seong-Yeo Kim, Taejon, both of Rep. of Korea

[73] Assignee: Bae-Wook Park, Taejon, Rep. of Korea

[21] Appl. No.: 820,342

[22] Filed: Jan. 14, 1992

[30] Foreign Application Priority Data

Jan. 14, 1991 [KR] Rep. of Korea ..... 91-408

[51] Int. Cl.[5] ..... A44B 11/00

[52] U.S. Cl. ..... 224/163; 70/456 R; 24/163 K

[58] Field of Search ..... 224/163; 24/3 K, 163 K; 70/456 R, 458

[56] References Cited

U.S. PATENT DOCUMENTS

| | | | |
|---|---|---|---|
| 1,578,468 | 3/1926 | Rankin | 24/163 K |
| 1,599,920 | 9/1926 | Pryor | 224/163 |
| 2,597,170 | 5/1952 | Oldal | 224/163 |
| 2,728,501 | 12/1955 | Hill | 70/456 R |
| 3,407,636 | 10/1968 | Kovacevic | 70/456 R |
| 3,677,044 | 7/1972 | De Frees | 70/456 R |
| 3,827,263 | 8/1974 | Starrett | 70/456 R |
| 4,113,157 | 9/1978 | Woodbury | 24/163 K |
| 5,046,343 | 9/1991 | Miwa | 70/456 R |

*Primary Examiner*—Linda J. Sholl

*Attorney, Agent, or Firm*—Evenson, McKeown, Edwards & Lenahan

[57] ABSTRACT

Disclosed is a plate-like belt buckle for storing a spare key for an automobile, comprising a groove diagonally formed in the rear side of said belt buckle for receiving said spare key; and a plurality of holding lugs for enclosing and holding said spare key received in said groove.

1 Claim, 1 Drawing Sheet

BELT BUCKLE FOR STORING A SPARE KEY FOR AN AUTOMOBILE

TECHNICAL BACKGROUND OF THE INVENTION

The present invention concerns a belt buckle for storing a spare key for an automobile.

Generally an automobile driver stores the spare key in a storing device attached to a portion of the outside of the body of an automobile. Hence, the spare key may be used by a thief to steal the automobile. Moreover, the structure of the conventional storing device is too complicated to simply store the spare key, thus decreasing the utility.

SUMMARY OF THE INVENTION

It is an object of the present invention to provide a belt buckle for safely storing a spare key for an automobile.

It is another object of the present invention to provide a belt buckle for safely storing a spare key for an automobile that may be easily constructed with a low cost.

According to the present invention, there is provided a plate-like belt buckle for storing a spare key for an automobile, comprising a groove diagonally formed in the rear side of said belt buckle for receiving said spare key; and a plurality of holding lugs for enclosing and holding said spare key received in said groove.

The present invention will now be described more specifically with reference to the drawings attached only by way of example.

BRIEF DESCRIPTION OF THE ATTACHED DRAWINGS

DETAILED DESCRIPTION OF THE ATTACHED DRAWINGS

Figure 1:
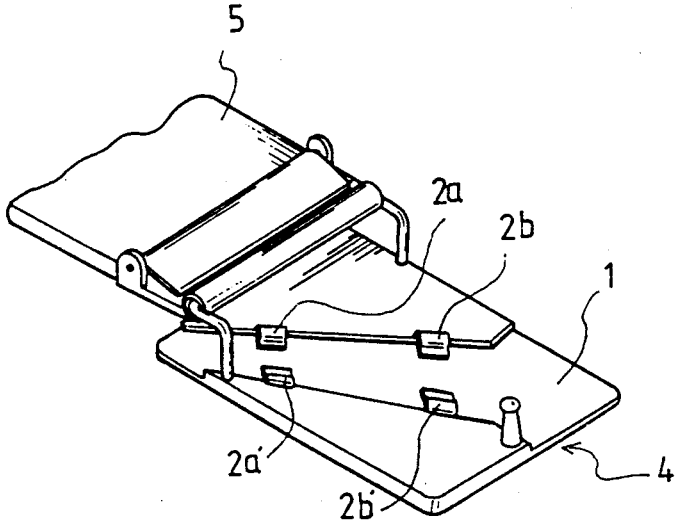
FIG. 1 is a perspective view of a belt buckle according to the present invention.

A conventional belt buckle 4 is shown with an inventive device in FIG. 1. The inventive device for storing a spare key for an automobile comprises a groove 1 diagonally formed in conformity with the spare key in the rear side of the belt buckle 1 and a plurality of holding lugs 2*a*, 2*a*', 2*b*, and 2*b*' arranged along both sides of the groove 1. The lugs 2*a* and 2*b* respectively face the lugs 2*a*' and 2*b*'. The belt buckle 4 is formed of a plate with a given thickness.

The reason that the groove 1 is diagonally formed in the rear side of the buckle 4 is to prevent the spare key 3 from protruding from the outer edge of the buckle when received in the groove 1. The groove 1 is formed in conformity with the shape and size of the spare key, and shallow considering the thicknesses of the spare key 3 and buckle 4, so as to climinate aesthetical problems.

The plurality of holding lugs 2*a*, 2*a*', 2*b*, and 2*b*' enclose and firmly hold the spare key received in the groove 1. The spare key 3 is detachably received in the groove 1 by inserting between the plurality of lugs 2*a*, 2*a*', 2*b*, and 2*b*'.

Figure 2:
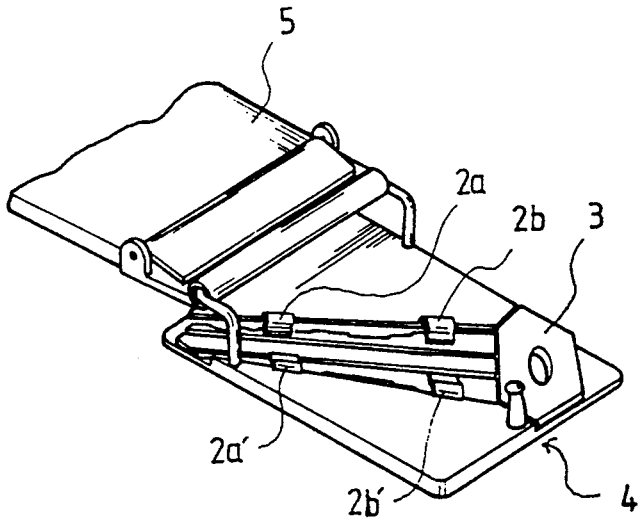
FIG. 2 is a view similar to FIG. 1 for illustrating a spare key stored in the belt buckle.
Figure 3:
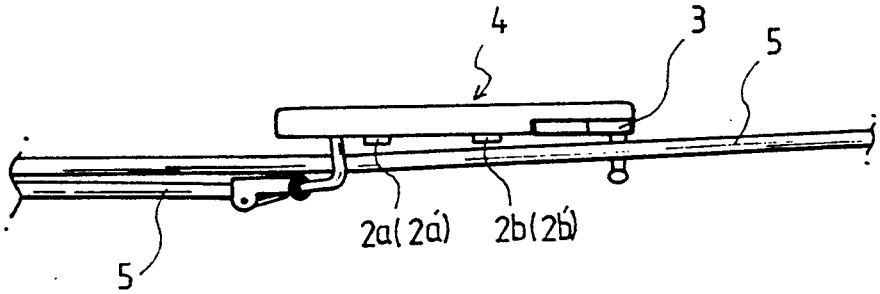
FIG. 3 is a side view of a belt buckle according to the present invention holding the free end of the belt.

As shown in FIGS. 2 and 3, the spare key 3 is placed in the groove 1 between the buckle 4 and the belt 5, so that, as captured by lugs 2*a*, 2*a*', 2*b*, 2*b*', the key does not protrude beyond the edge of the buckle. The inventive device may be built in the rear side of any conventional plate-like belt buckle 4 simultaneously when molding the buckle. In addition, the plurality of holding lugs 2*a*, 2*a*', 2*b*, and 2*b*' are attached to the rear side of the buckle by welding.

Thus, an automobile driver may always use the spare key held in the inventive device built in the rear side of the belt buckle 4 that he wears, without losing. Moreover, there is a gap between the rear side of the buckle and the belt that is usually greater than the thickness of the spare key, as shown in FIG. 3, so that the belt with the buckle may be conveniently worn on a person without causing any aesthetical problems.

What is claimed is:

1. A belt buckle for storing a spare key for an automobile comprising a plate having a front side and a rear side, said buckle having a fitting to accommodate a belt adjacent to the rear side of said plate, said rear side of said plate having a diagonal groove which extends into said plate from a rear surface of said plate to a prescribed depth into said plate, said diagonal groove being configured in general conformance with the size and shape of said spare key, so that said key, when inserted into said groove, does not protrude beyond edges of said plate, and a plurality of retention lugs arranged along sides of said groove, said retention lugs holding said key in place in said groove.

* * * * *